US010232620B2

(12) United States Patent
Cumbie et al.

(10) Patent No.: US 10,232,620 B2
(45) Date of Patent: Mar. 19, 2019

(54) PRINTHEAD WITH S-SHAPED DIE

(71) Applicant: Hewlett-Packard Development Company, L.P., Houston, TX (US)

(72) Inventors: Michael W. Cumbie, Albany, OR (US); Silam J. Choy, Corvallis, OR (US); Chien-Hua Chen, Corvallis, OR (US); Devin Alexander Mourey, Albany, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/747,639

(22) PCT Filed: Oct. 13, 2015

(86) PCT No.: PCT/US2015/055227

§ 371 (c)(1),
(2) Date: Jan. 25, 2018

(87) PCT Pub. No.: WO2017/065743

PCT Pub. Date: Apr. 20, 2017

(65) Prior Publication Data

US 2018/0215147 A1 Aug. 2, 2018

(51) Int. Cl.

| | |
|---|---|
| ***B41J 2/145*** | (2006.01) |
| ***B41J 2/155*** | (2006.01) |
| ***B41J 2/14*** | (2006.01) |
| ***B41J 2/16*** | (2006.01) |
| ***B41J 2/21*** | (2006.01) |

(52) U.S. Cl.

CPC ..... *B41J 2/145* (2013.01); *B41J 2/14072* (2013.01); *B41J 2/155* (2013.01); *B41J 2/1603* (2013.01); *B41J 2/1623* (2013.01); *B41J 2/1632* (2013.01); *B41J 2/1635* (2013.01); *B41J 2/1637* (2013.01); *B41J 2/2103* (2013.01); *B41J 2002/14475* (2013.01); *B41J 2002/14491* (2013.01); *B41J 2202/20* (2013.01); *B41J 2202/22* (2013.01)

(58) Field of Classification Search

None

See application file for complete search history.

(56) References Cited

U.S. PATENT DOCUMENTS

| | | | |
|---|---|---|---|
| 6,450,614 | B1 | 9/2002 | Scheffelin et al. |
| 8,292,405 | B2 | 10/2012 | Silverbrook |

(Continued)

OTHER PUBLICATIONS

IP.com search.*

(Continued)

*Primary Examiner* — Lisa Solomon

(74) *Attorney, Agent, or Firm* — HP Inc.—Patent Department

(57) ABSTRACT

A printhead may include a number of s-shaped dies embedded in a moldable substrate. An medium-wide array may include a number of printheads with each printhead including a number of s-shaped dies and an ejection fluid feed slot to provide a single type of ejection fluid to the s-shaped dies. An s-shaped die of a printhead may include a number of columns of nozzles and an electrical interconnect coupled to a number of firing chambers associated with each of the nozzles, the electrical interconnect positioned adjacent to the number of columns.

15 Claims, 9 Drawing Sheets

(56) References Cited

U.S. PATENT DOCUMENTS

| | | | | |
|---|---|---|---|---|
| 8,348,385 | B2 | 1/2013 | Benjamin et al. | |
| 8,777,376 | B2 | 7/2014 | Anderson et al. | |
| 2005/0200669 | A1 | 9/2005 | Timm et al. | |
| 2012/0212540 | A1 | 8/2012 | Dietl | |
| 2013/0106954 | A1* | 5/2013 | Choy | B41J 2/155 347/42 |
| 2014/0253636 | A1 | 9/2014 | Silverbrook | |

OTHER PUBLICATIONS

IP.com search (Year: 2018).*
International Search Report and Written Opinion for International Application No. PCT/US2015/055227 dated Jul. 4, 2016, 20 pages.
Watanabe, S., et al "High Quality, High Speed, Next-generation Inkjet Technology with Scalability from Serial Printheads to Lineheads" NIP & Digital Fabrication Conf 2014 1pg.

* cited by examiner

PRINTHEAD WITH S-SHAPED DIE

BACKGROUND

Silicon, as well as other materials, have become an expensive material used to construct printheads and printhead dies. In order to overcome the use of such an expensive material in a printhead the area used by the printhead has been reduced. The ability to reduce the area of the printhead has diminished recently because it is getting increasingly difficult to shrink the slot pitch (i.e., the width between ejection fluid feed slots) and consequently the distance between columns of nozzles further without adding excessive pen assembly cost associated with integrating smaller printhead dies.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
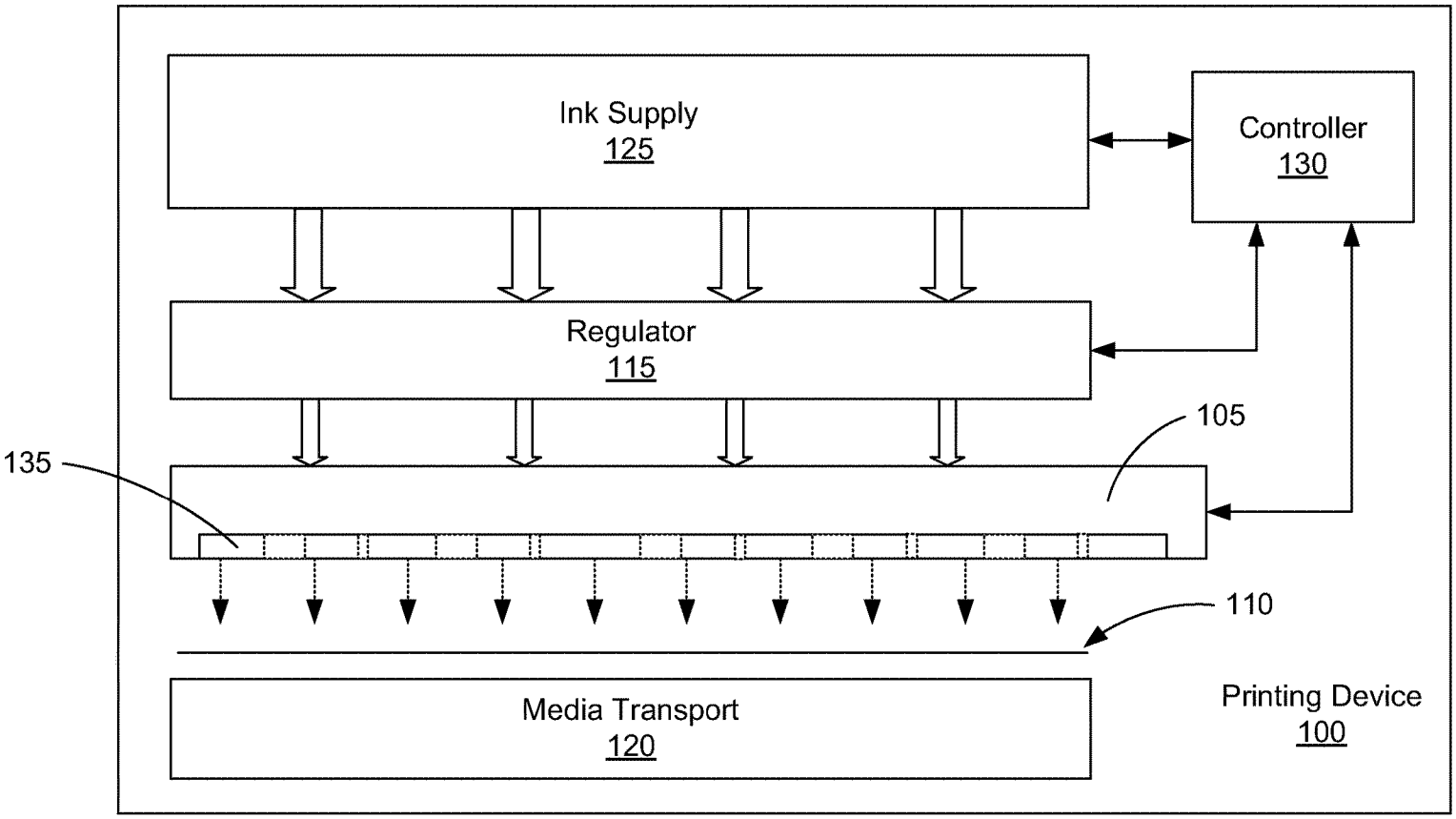
FIG. 1 is a block diagram of a printing device according to one example of the principles described herein.

As described above, the use of silicon in printhead dies is relatively more costly than other materials used to construct the rest of a printhead's components. Additionally, the costs associated with assembling and manufacturing the printhead and its components may also increase as the size of the printhead die decreases. In order to reduce these associated costs, printhead manufacturers have looked to reduce the slot pitch of the printhead. A slot pitch is the distance between ejection fluid feed slots under each column of nozzles. Because the nozzles are aligned over these ejection fluid feed slots, the slot pitch may also refer, in some examples, to the distance between the columns of nozzles. Reducing the slot pitch reduces the amount of silicon used to manufacture the entire die and consequently reduces the cost to manufacture the die. There is a limit, however, to how far the slot pitch can be reduced because of the nature of both the nozzles and the ejection fluid ejected from the nozzles. Additionally, the costs to produced reduced slot pitch printhead dies increases as the slot pitch decreases reducing the economic benefit of further reducing the slot pitch. Other aspects of the construction of the printhead are further complicated including reduction of ejection fluid slot feeds, bond pad contamination, among others.

The present specification describes a die of a printhead having an s-shape. The s-shape may be defined within a silicon wafer and may comprise two columns of nozzles defined in a layer of epoxy-based negative photoresist material such as SU-8. In one example, a number of those nozzles from each column may overlap each other. In the case where the nozzles overlap, in-line die stitching could be used to accommodate for any visible print defects on a printed substrate. A number of s-shaped dies can be aligned together along a common longitudinal axis to create a single printhead. Each of the ends of the s-shaped dies can be arranged to overlap each other as well and die stitching could be implemented to accommodate for any overlapping nozzles between s-shaped dies. Aligned s-shaped dies can be aligned along a medium-wide printbar to create a single medium-wide array. For ease of reading, this description may refer to medium-wide array printheads but in fact the array could span the width of any print medium including both 2D and 3D printing media such as pages and powder, respectively. The medium-wide array can be fed a single type of ejection fluid via a single ejection fluid feed slot. The type of fluid may be a distinct color or distinct agent. Additionally, any number of medium-wide arrays may be added to an existing medium-wide array to add distinct agents thereby allowing a printing device implementing the number of medium-wide arrays to print any number of colors.

Because of the shape of the s-shaped dies, a single electrical interconnect may be used to connect each firing chamber within each of the s-shaped dies to a printed circuit board running parallel to the s-shaped dies. This printed circuit board electrically connects the single electrical interconnects to a connection pad located at the ends of the print bar. The placement of the single electrical interconnect, in one example, may be adjacent a column of nozzles in the s-shaped die. In one example, the single electrical interconnects may be electrically coupled to a common circuit assembly such as a printed circuit assembly running parallel to the s-shaped dies. In this example, the common circuit assembly may be coupled to a printed circuit board or directly coupled to a connection pad.

The present specification also describes a printhead including a number of s-shaped dies embedded in a moldable substrate. In one example, the s-shaped die may include an electrical interconnect coupled to a non-end portion of each of the s-shaped dies.

The present specification further describes a medium-wide array, including a number of printheads, each printhead including a number of s-shaped dies and an liquid feed slot to provide a single type of ejection fluid to the number of columns of nozzles.

Further, the present specification describes an s-shaped die of a printhead, including a number of columns of nozzles, and an electrical interconnect coupled to a number of firing chambers associated with each of the nozzles, the electrical interconnect positioned adjacent to the number of overlapping nozzles As used in the present specification and in the appended claims, the term "epoxy molding compound (EMC)" is broadly defined herein as any materials including at least one epoxide functional group. In one example, the EMC is a self-cross-linking epoxy. In this example, the EMC may be cured through catalytic homopolymerization. In another example, the EMC may be a polyepoxide that uses a co-reactant to cure the polyepoxide. Curing of the EMC in these examples creates a thermosetting polymer with high mechanical properties, and high temperature and chemical resistance.

Additionally, as used in the present specification and in the appended claims, the term "a number of" is broadly defined as any positive number comprising 1 to infinity.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

FIG. 1 is a block diagram of a printing device (100) comprising a print bar comprising a number of molded s-shaped dies (135) according to one example of the principles described herein. The printing device (100) may include a print bar (105) that, in one example, spans the width of a print medium (110). The printing device (100) may further include flow regulators (115) associated with the print bar (105), a medium transport mechanism (120), ink or other ejection fluid supplies (125), and a controller (130). The controller (130) may represent the programming, processor(s), associated data storage device(s), and the electronic circuitry and components used to control the operative elements of a printing device (100). The print bar (105) may include an arrangement of molded s-shaped dies (135) for dispensing printing fluid onto a sheet or continuous web of paper or other print medium (110). The print bar (105) in FIG. 1 includes multiple molded s-shaped dies (135) spanning print medium (110). However, different print bars (105) are contemplated in the present specification that may include more or less molded s-shaped dies (135) and may be fixed to a medium-wide array bar as depicted in FIG. 1 or on a movable print cartridge.

Figure 2:
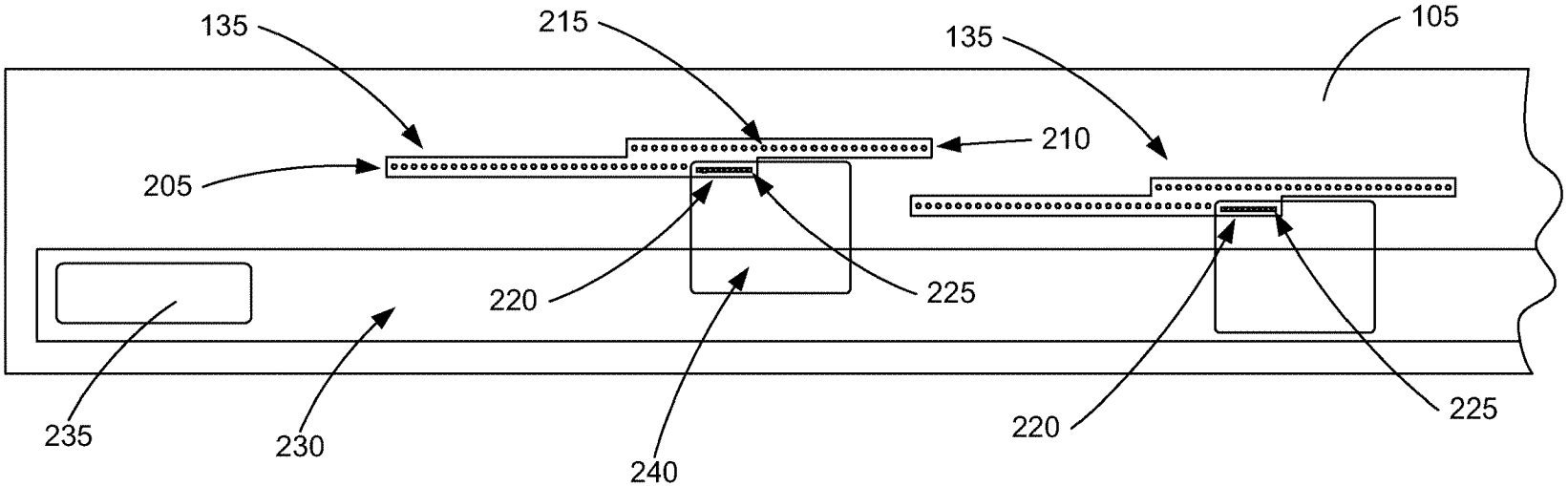
FIG. 2 is a block diagram showing a print bar including a number of s-shaped dies according to one example of the principles described herein.

The molded s-shaped dies (135) may be arranged on the print bar (105) as depicted in FIG. 2. FIG. 2 is a block diagram showing a print bar (105) including a number of s-shaped dies (135) according to one example of the principles described herein. The s-shaped die (135) may include a first (205) and second (210) column of nozzles (215). The s-shaped die (135) may also include an electrical interconnect (220) comprising a number of electrical connections (225) that create an interface between individual firing resistors associated with each nozzle (215) and a printed circuit board used to provide a firing signal to each of the nozzles (215). These will now be described in more detail below.

The s-shaped die (135) may be created out of a single piece of silicon. The creation of the s-shaped die (135) can be accomplished by, for example, stealth dicing of the silicon wafer by using a laser cutting machine. In one example, the two columns (205, 210) of nozzles (215) overlap each other. The s-shaped die (135) with and each of the columns (205, 210) lie perpendicular to the path of the medium (FIG. 1, 110) as the medium is fed through the printing device (FIG. 1, 100). Thus, nozzles considered to be "overlapping" are those nozzles that are aligned with other nozzles (215) from another column (205, 210) and that together run parallel with the path of the medium (FIG. 1, 110) as the medium is fed through the printing device (FIG. 1, 100). The overlap of the first (205) and second columns (210) of nozzles (215) allows for in-line stitching of those nozzles (215). Stitching of the nozzles (215) is accomplished, in one example, by timing the firing of any overlapping nozzles (215) such that the combined firing of ejection fluid from the overlapped nozzles (215) does not eject any more or less ejection fluid than other non-overlapping nozzles (215). In this example, the controller (FIG. 1, 130) may execute instructions to fire any overlapping nozzles (215) in order to accommodate for this in-line stitching process. The stitching instructions may be operative to cause a first and a second ejection fluid nozzle that are overlapping to eject drops of ejection fluid in a certain region of the print medium (FIG. 1, 110). In an example, the stitching instructions may be operative to cause the first and second nozzles (215) that are overlapping to adjust the density of ejection fluid ejected from the nozzles (215).

In one example, any two neighboring s-shaped die (135) aligned as depicted in FIG. 2 can have any number of overlapping ends comprising nozzles that are not stitched in-line. Instead, in this example, those columns (205, 210) of nozzles that overlap each other in neighboring columns (205, 210) may also be stitched as described above. In this case, any nozzles (215) within any two neighboring s-shaped die (135) aligned as depicted in FIG. 2 can be stitched together by in one example, timing the firing of any overlapping nozzles (215) such that the combined firing of ejection fluid from the overlapped nozzles (215) does not eject any more or less ejection fluid than other non-overlapping nozzles (215). The stitching of the nozzles (215) prevents visual defects in any printed medium.

Referring still to FIG. 2, each s-shaped die (135) may include an electrical interconnect (220) to electrically connect the s-shaped die (135) to, in one example, a printed circuit board (230). In one example, the single electrical interconnects may be electrically coupled to a common circuit assembly such as a printed circuit assembly running parallel to the s-shaped dies. In this example, the common circuit assembly may be coupled to a printed circuit board or directly coupled to a connection pad. The present specification, however, contemplates the use of any type of common electrical source to which the electrical interconnects can be coupled in order to provide each s-shaped die (135) with the electrical power used to eject ejection fluid from the nozzles.

Each of the electrical interconnects (220) may include a number of electrical pads (225) to electrically couple the printed circuit board (230) to a number of firing chambers included in the s-shaped dies (135) and that are associated with a number of nozzles (215). The printed circuit board (230) may also electrically couple each of the electrical interconnects (220) with a connection pad (235). The connection pad (235) may interface with a surface mounted device that delivers electrical signals eventually to the firing chambers in order to eject an ejection fluid out of the nozzles (215).

The electrical interconnect (220) is disposed at an intermediumry position to the ends of each of the s-shaped die (135). In the example shown in FIG. 2, the electrical interconnect (220) is positioned at an intermediumry point between the two ends of the s-shaped die (135) and next to where the two columns (205, 210) of nozzles (215) overlap. In this position, the electrical interconnect (220) may serve as a single point where electrical signals may be passed to the firing chambers associated with each of the nozzles (215). Unlike where an electrical interconnect is coupled at each end of a die, the placement of the electrical interconnect (220) at an intermediumte area to the ends uses relatively less power to drive the firing signals to each of the firing chambers. Additionally, there are relatively less wire-bond joints created with an intermediumte electrical interconnect (220) than with interconnects created at the ends of the s-shaped die (135). In one example, the electrical interconnect (220) may be coupled at a single end or location on the s-shaped die (135). The present specification, therefore, contemplates the use of a single electrical interconnect coupled to each s-shaped die (135) and leading to a printed circuit board. This allows for less space on the print bar (105) used for multiple interconnects associated with each s-shaped die (135).

In the example of FIG. 2, an encapsulant (240) may be placed over the electrical interconnect (220) and any wire-bonds associated with the electrical interconnect (220) to eliminate exposure of the wire bonds (105) to the surrounding environment. The electrical interconnect (220), as depicted in FIG. 2 is located on a single side of the s-shaped die (135) from which the jettable fluid is ejected from the nozzles (113). This results in a situation where the electrical interconnect (220) is exposed to possible friction from the print medium (110) passing through the printing device (FIG. 1, 100), dust and other contaminants from the print medium and other sources, and moisture from the surrounding air. In order to eliminate possible contamination to the electrical interconnect (220), the encapsulant (240) may be placed on the electrical interconnect (220) and associated wirebonds.

Although FIGS. 1 and 2 depict a specific number of s-shaped dies (135) on a printbar (105), the number of s-shaped dies (135) may vary based on the dimensions and purpose of the printbar (105). In the example where the printbar (105) is a medium-wide array, a number of s-shaped dies (135) may be molded into the printbar (105) to, when arranged in the configuration as shown and described in connection with FIG. 2, cover an entire width of a page of print medium (110). In one example, where a print cartridge is used, a number of s-shaped dies (135) may be molded into the printhead created on the cartridge and the cartridge may pass across the surface of the page of print medium (110) as the print medium (110) is passed through the printing device (FIG. 1, 100). In one example, the number of s-shaped dies (135) may be dependent on the number of nozzles (215) defined in each two columns (205, 210) of nozzles (215).

Figure 3:
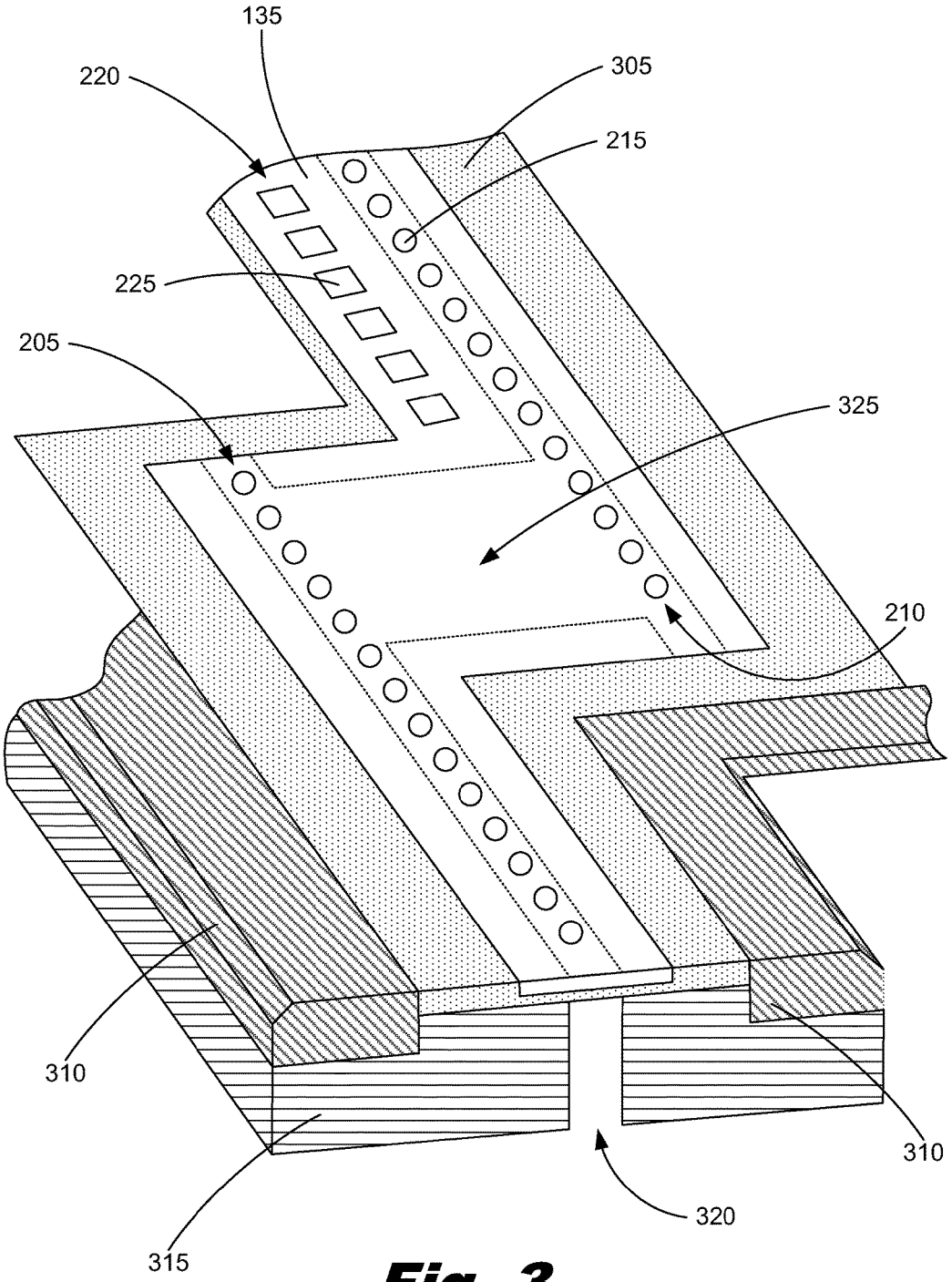
FIG. 3 is a cut away perspective view of an s-shaped die according to an example of the principles described herein.

FIG. 3 is a cut away perspective view of an s-shaped die (135) according to an example of the principles described herein. In the example shown in FIG. 3, the s-shaped die (135) has been embedded or overmolded into, for example, a layer of epoxy mold compound (EMC) (305). Embedding the s-shaped die (135) into the EMC (305) allows for the ability to mold slots into, for example, a printhead instead of removing material to fit the s-shaped die (135) therein. The electrical interconnect (220) may be defined on the s-shaped die (135) at an intermediumte point on the s-shaped die (135) as described above.

In one example, the s-shaped die (135) molded into the EMC (305) may be placed co-planar to the s-shaped die (135). In another example, the s-shaped die (135) molded into the EMC (305) may be placed and glued onto a printed circuit board (PCB) (310). The s-shaped die (135) molded into the EMC (305) and placed on the PCB (310) may then be placed on a die carrier (315) made of plastic or other resilient material.

In one example, the s-shaped die (135) may be fluidly coupled to an ejection fluid slot (320) carrying a single color or type of ejection fluid. Although FIG. 3 shows a single ejection fluid slot (320), any number of ejection fluid slots (320) may provide to any number of s-shaped dies (135) a single color or type of ejection fluid.

In the example depicted in FIG. 3, the single ejection fluid slot (320) may run the entire length of the both the first (205) and second (210) column of nozzles (215) as indicated by the ghost lines depicted in FIG. 3. In this example, a fluid bridge (325) may be created in the ejection fluid slot (320) to fluidly couple the ejection fluid slot (320) under the first (205) and second (210) column of nozzles (215). In one example, the ejection fluid slot (320) traverses under first (205) and second (210) column of nozzles (215) of a plurality of s-shaped dies (135). In this example, the ejection fluid slot (320) may be defined within the die carrier (315) directly under each column (205, 210) of nozzles (215) of each s-shaped die (135).

FIG. 3 depicts two single columns of nozzles (205, 210) each including a number of nozzles running generally parallel to the outer edges of the epoxy mold compound (EMC) (305). However, the number and arrangement of the nozzles in FIG. 3 is merely meant to be an example and other nozzle configurations are contemplated in the present specification. In one example, each of the columns of nozzles (205, 210) may each include a number of rows of nozzles themselves. In one example, these individual rows of nozzles may be staggered with respect to each other.

Additionally, FIG. 3 shows the two columns of nozzles (205, 210) overlapping by a number of nozzles. As described herein, these overlapping nozzles may, when in operation, cooperatively work together to eject a predetermined amount of ejection fluid onto the print medium (FIG. 1, 110) via stitching. In another example, the two columns of nozzles (205, 210) do not overlap and the stitching process described herein is not used. Instead, in this example, the end nozzles of each of the columns of nozzles (205, 210) are separated by a distance equal to the distance between any two neighboring nozzles within the individual columns of nozzles (205, 210).

Further, FIG. 3 shows a specific placement of the electrical interconnect (220) relative to the columns of nozzles (205, 210). In this example, the electrical interconnect (220) is a side electrical interconnect in that the electrical interconnect (220) is positioned at a side of the s-shaped die (135). In other examples, the electrical interconnect (135) may be positioned at an end of either of the columns of nozzles (205, 210) or some other location on the s-shaped dies (135).

The s-shaped die (135) as described in FIGS. 1-3 provides for reduced use of silicon to create a die. In one example, the s-shaped die (135) may be 0.620 mm by 13.8 mm. This is relatively less use of silicon per s-shaped die (135) than that used to create other types of printhead dies or multi-color medium-wide arrays comprising a plurality of dies.

Figure 4A:
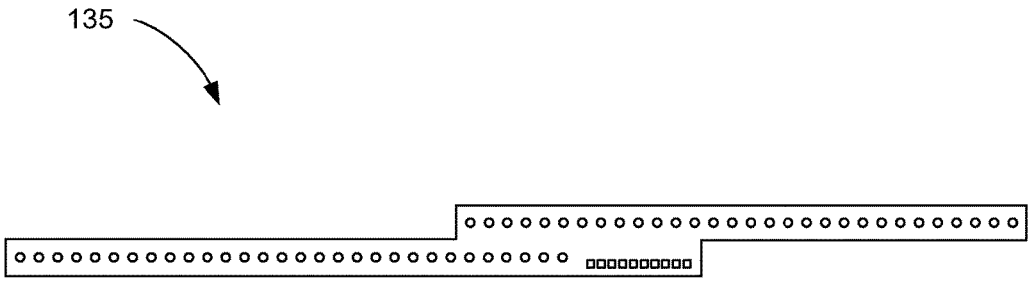
FIG. 4A is a block diagram showing an s-shaped die according to an example of the principles described herein.
Figure 4B:
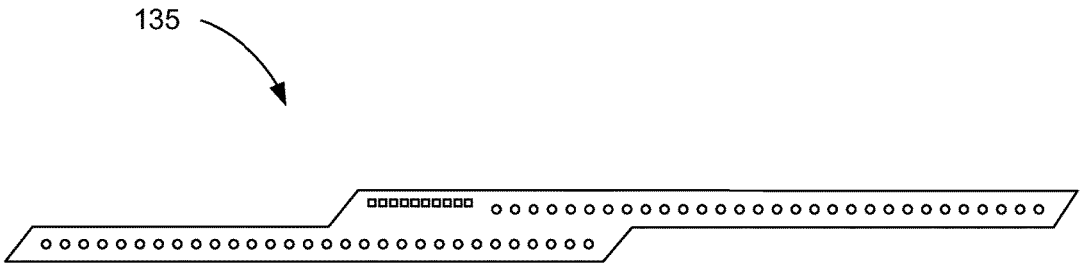
FIG. 4B is a block diagram showing an s-shaped die according to an example of the principles described herein.

FIG. 4A is a block diagram showing an s-shaped die (135) according to an example of the principles described herein. FIG. 4B is a block diagram showing an s-shaped die (135) according to an example of the principles described herein. FIGS. 4A and 4B show two examples of how an s-shaped die (135) may be created. In FIG. 4A, the s-shaped die (135) may include 90 degree corners that cause each edge of the s-shaped die (135) to either run parallel or perpendicular to the to the path of the medium (FIG. 1, 110) as the medium is fed through the printing device (FIG. 1, 100). In the example shown in FIG. 4B, the s-shaped die (135) may include skewed edges at the ends of the s-shaped die (135) as well as near the areas where the first (205) and second (210) column of nozzles (215) overlap. In this example, where the s-shaped dies (135) are cut from a silicon wafer via, for example, stealth dicing of the silicon wafer, an amount of silicon may not be wasted in the process due to the skewed edges.

Figure 5:
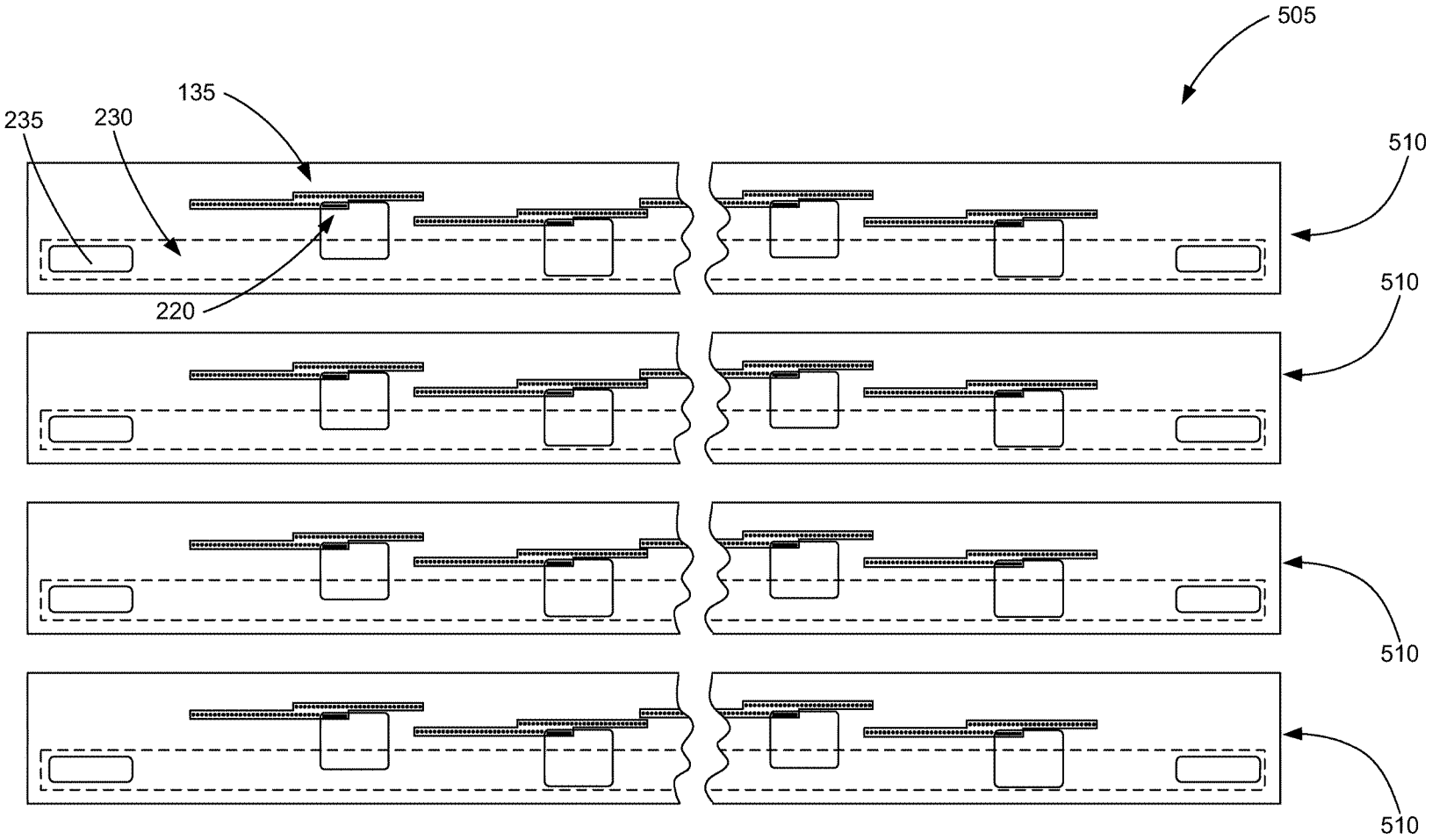
FIG. 5 is a block diagram of a medium-wide array according to one example of the principles described herein.

FIG. 5 is a block diagram of a medium-wide array (PWA) (505) according to one example of the principles described herein. The PWA (505) may include a plurality of printheads (510) each comprising a number of s-shaped dies (135) as described above. Each of the printheads (510) may be supplied with a different color or type of ejection fluid via their individual ejection fluid slots (320). In one example, the number of printheads (510) is equal to the number of ink colors used to produce an image on a sheet of print medium (110). In this example, the colors may be black yellow, cyan, and magenta. In one example, more than four printheads (510) may be assembled within a printing device (FIG. 1, 100) in order to increase the variety of colors available for printing.

Figure 6:
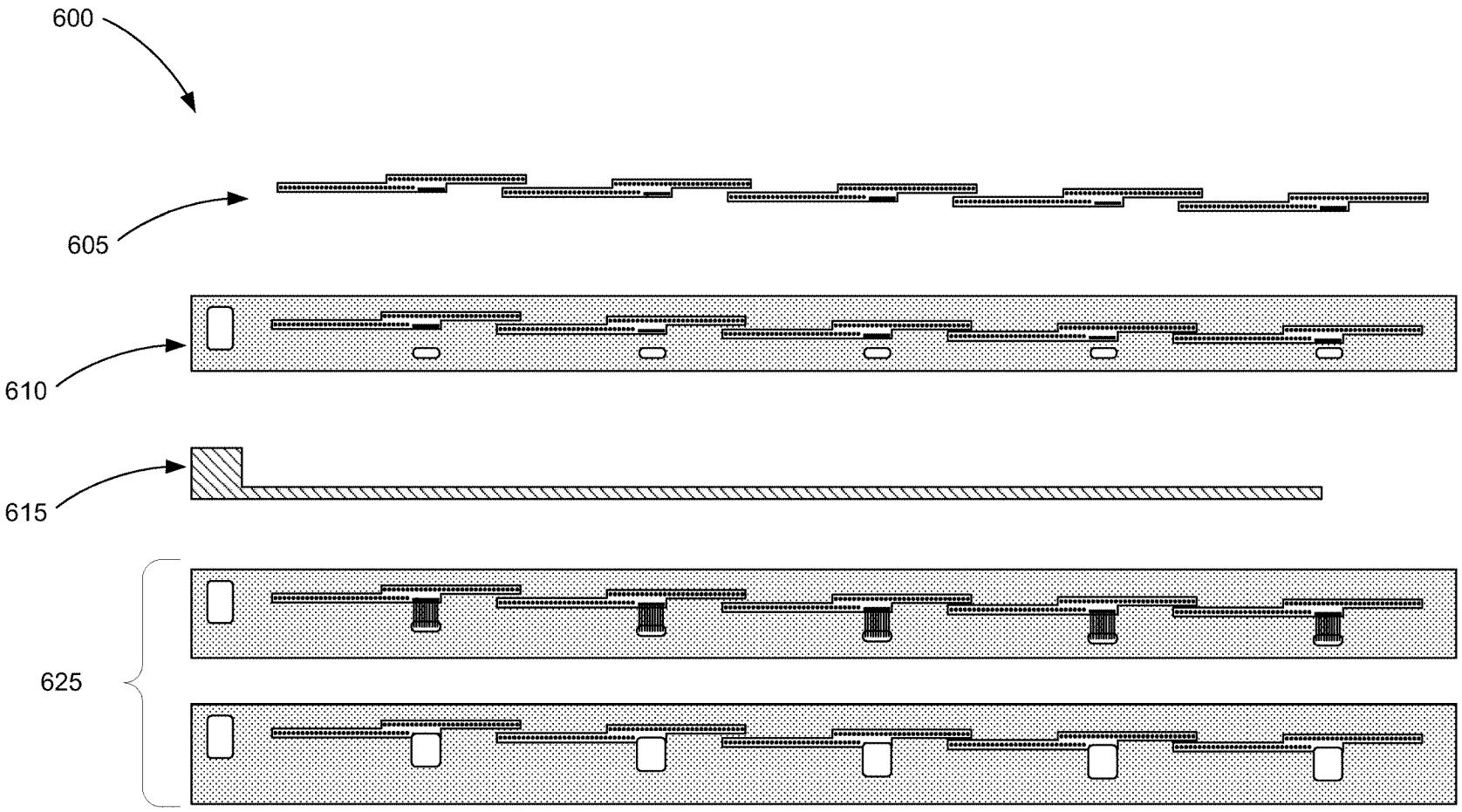
FIGS. 6 and 7 show a method of making a medium-wide array according to one example of the principles described herein.
Figure 7:
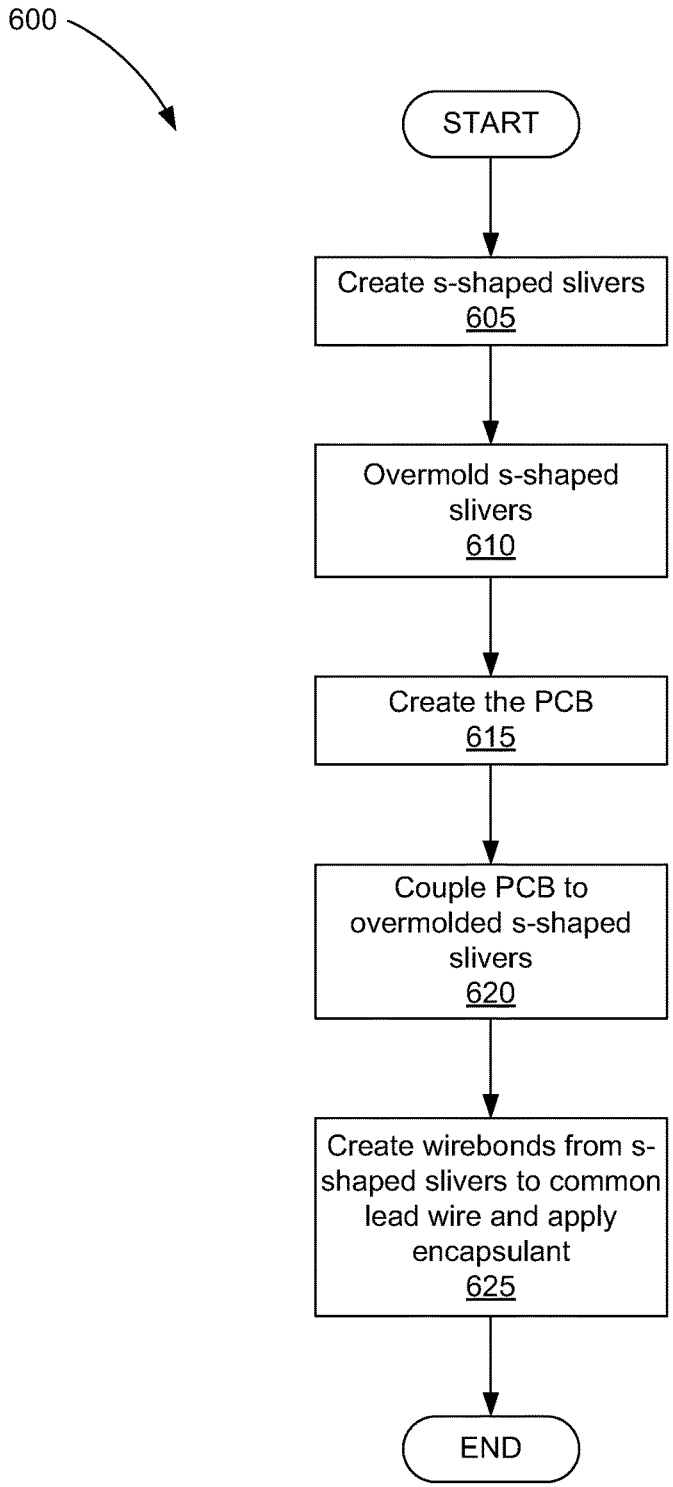

FIGS. 6 and 7 show a method (600) of making a medium-wide array according to one example of the principles described herein. FIG. 6 is a series of block diagrams showing assembly of the medium-wide array after various processes according to the method further described in the flowchart of FIG. 7. These figures will now be described.

The method (600) may begin with creating a number of s-shaped dies (135). As described above, a die may include first (205) and second (210) column of nozzles (215) as well as firing chambers defined within the silicon. The process to create (605) the s-shaped dies (135) may include both the creation of ejection fluid channels within a silicon substrate and the creation of individual nozzles (215) and firing chambers by applying a layer of epoxy-based negative photoresist material such as SU-8. In one example, this may be done via a masking process. In one example, each s-shaped dies (135) may be created together on a single silicon wafer and stealth diced out of the wafer.

The method (600) may continue with overmolding (610) the s-shaped die (135) with EMC (FIG. 3, 305). In one example, the s-shaped dies (135) are aligned and the EMC (FIG. 3, 305) is overmolded to the aligned s-shaped dies (135). In this example, the dies (102) are arranged with respect to one another according to a desired die (102) arrangement shown in, for example, FIGS. 2 and 5. Uncured EMC (FIG. 3, 305) is deposited around the s-shaped die (135). The EMC (FIG. 3, 305) may include any polyepoxides that include any reactive prepolymers and polymers which contain epoxide groups. The EMC (FIG. 3, 305) may be reacted (i.e., cross-linked) either with themselves through catalytic homopolymerisation, or with a wide range of co-reactants including polyfunctional amines, acids and acid anhydrides, phenols, alcohols, thiols, other co-reactants, or combinations thereof. These co-reactants may be referred to as hardeners or curatives, and the cross-linking reaction may be referred to as curing. Reaction of polyepoxides with themselves or with polyfunctional hardeners forms a thermosetting polymer, often with high mechanical properties, and temperature, and chemical resistance.

The method (600) may continue with creating (615) the PCB (FIG. 3, 310). The creation (615) of the PCB (FIG. 3, 310) may include creating the printed circuit board (FIG. 2, 230) on the surface of the PCB (FIG. 3, 310) as well as the connection pad (FIG. 2, 235) and other wirebonds.

The method (600) may also include coupling (620) the PCB (FIG. 3, 310) to the overmolded s-shaped dies (135). Coupling (620) the PCB (FIG. 3, 310) to the overmolded s-shaped dies (135) may be done by applying a glue to the surfaces of the overmolded s-shaped dies (135) and PCB (FIG. 3, 310) at specific locations to maintain a sealed fit between the two.

The method (600) may further include creating (625) wirebonds from the electrical interconnects (FIG. 2, 220) of the s-shaped dies (135) to the printed circuit board (FIG. 2, 230) and applying an encapsulant (FIG. 2, 240) over the electrical interconnect (FIG. 2, 220) and wirebonds.

Figure 8:
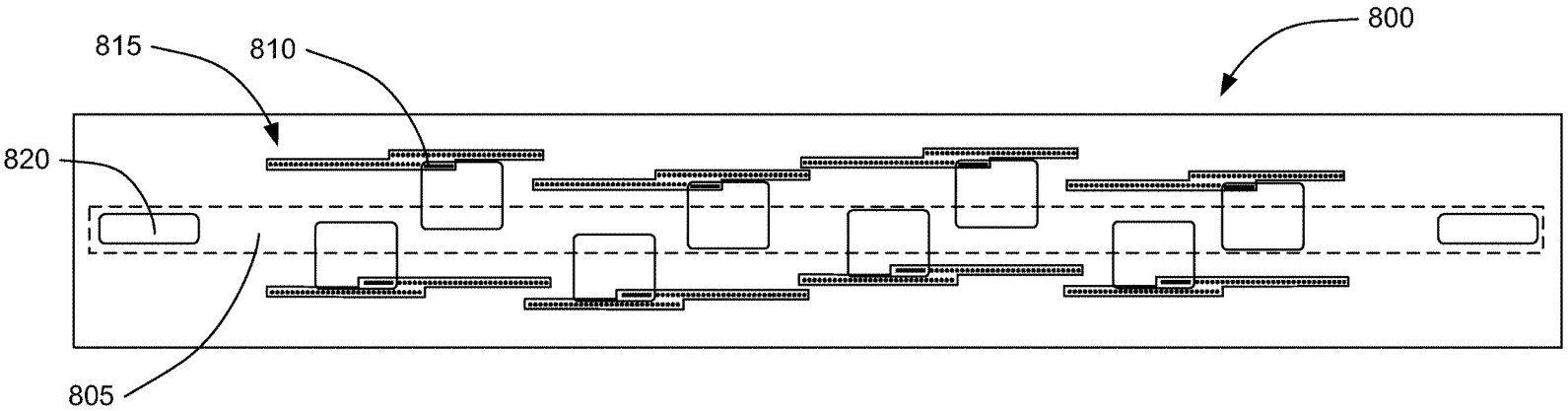
FIG. 8 is a block diagram of a print bar including two sets of a number of s-shaped dies according to one example of the principles described herein.

FIG. 8 is a block diagram of a print bar (800) including two sets of a number of s-shaped dies (135) according to one example of the principles described herein. In FIG. 8, two sets of s-shaped dies (815) may be aligned along opposite sides of a central printed circuit board (805). In this example, the single and central printed circuit board (805) may couple each of the electrical interconnects (810) from each s-shaped die (815) to a centrally located connection pad (820). In one example, two ejection fluid slots similar to those described in connection with FIG. 3 may be defined in the print bar (800) under each set of s-shaped dies (815). In this configuration, two separate colors or types of ejection fluid may be used. For example, the print bar (800) may be capable of ejecting from one of the sets of s-shaped dies (815) a cyan ink while the other set of s-shaped dies (815) may eject a magenta ink. In this example, two print bars (800) may be used in a printing device (FIG. 1, 100) to eject all four of a cyan, magenta, yellow, and black ink in order to print with those four colors of ink. Other examples exist where different colors are paired together in a single print bar (800) and the present specification contemplates these uses of the print bar (800). In one example, any number of rows of s-shaped dies (815) may be used as described above to allow for a single print bar (800) capable of ejecting all four of a cyan, magenta, yellow, and black color of ink.

The layout of the s-shaped dies (815) in FIG. 8 may include pairing s-shaped dies (815) across from each other and using the same encapsulant to cover the wirebonds as describe above. In the example shown in FIG. 8, the s-shaped dies (815) positioned across the central printed circuit board (805) from each other are mirror opposite of each other. Although FIG. 8 shows the electrical interconnects (810) not aligning with each other, the present specification contemplates the creation of the s-shaped dies (815) such that their electrical interconnects (810) align vertically. This may be done to, for example, apply the encapsulant easier.

Figure 9:
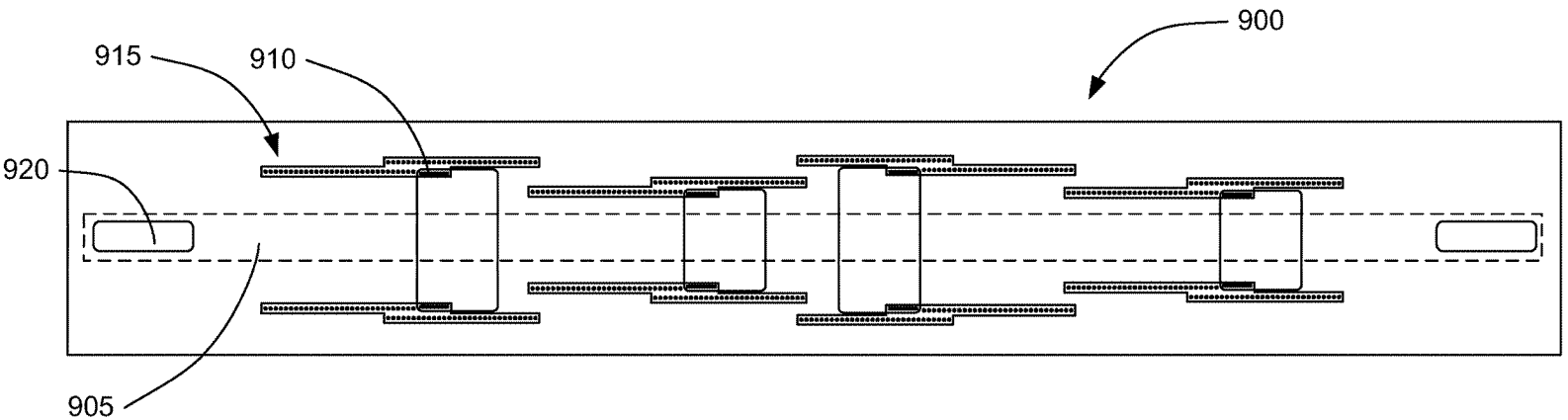
FIG. 9 is a block diagram of a print bar including two sets of a number of s-shaped dies according to one example of the principles described herein.

FIG. 9 is a block diagram of a print bar (900) including two sets of a number of s-shaped dies (135) according to one example of the principles described herein. In this example, the s-shaped dies (915) aligned across the central printed circuit board (905) include aligned electrical interconnects (910). In this case the central printed circuit board (905) electrically couples each of the electrical interconnects (910) to a common and central a connection pad (920) similar to that descried in connection with FIG. 8. In this example, however, the encapsulant used to cover and protect the electrical interconnects (910) and any associated wirebonds may be joined due to the alignment of the electrical interconnects (910). This may result in less encapsulant being used to manufacture the print bar (900) and thereby reduce costs associated with the manufacture of the print bar (900).

Figure 10:
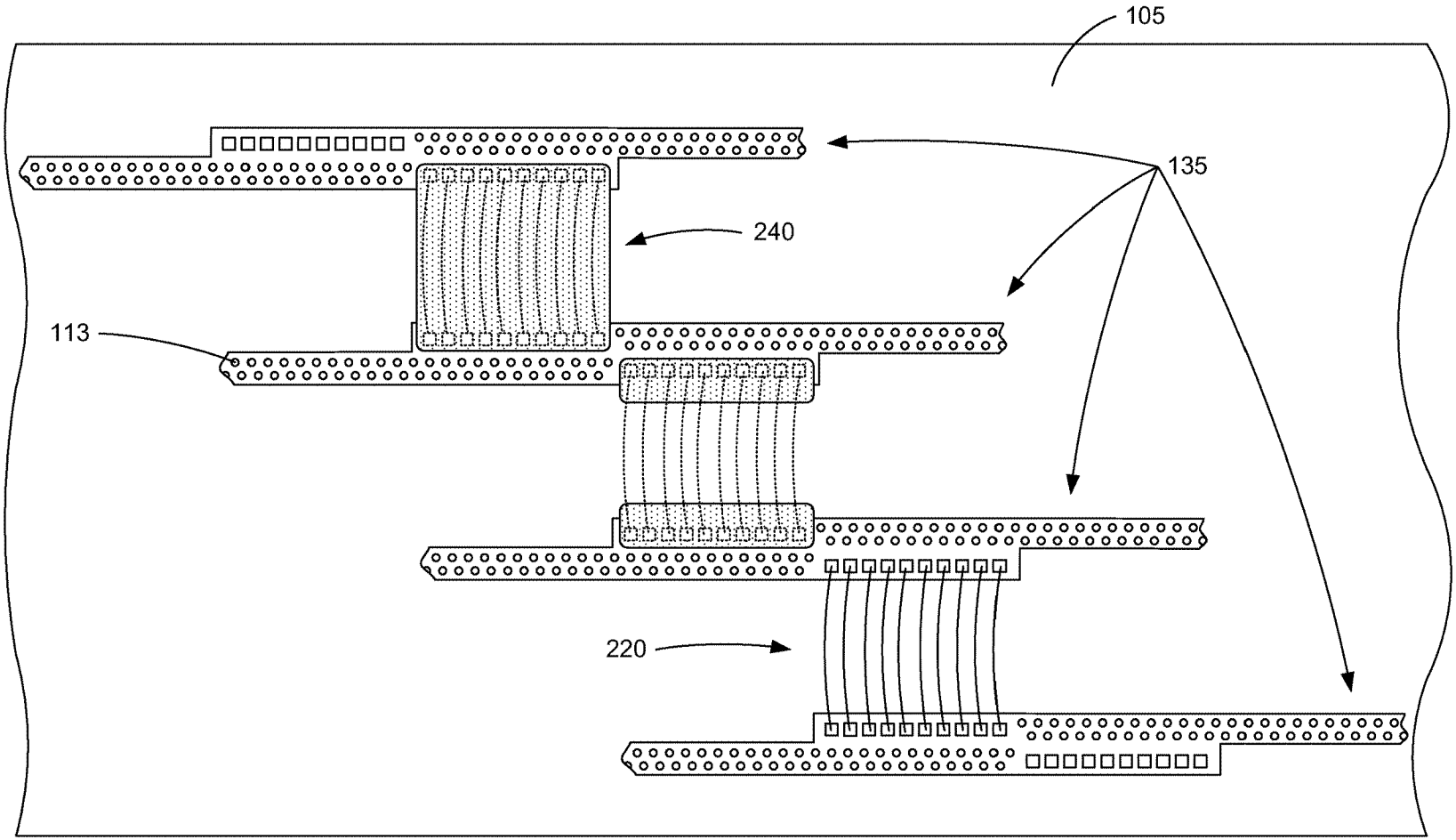
FIG. 10 is a block diagram of a print bar including a number of s-shaped dies according to one example of the principles described herein.

FIG. 10 is a block diagram of a print bar (105) including a number of s-shaped dies (135) according to one example of the principles described herein. In the example shown in FIG. 10, the print bar (105) may include any number of s-shaped dies (135) comprising a number of electrical interconnects (220) coupled in series from one s-shaped die (135) to another s-shaped die (135) in a "daisy chain" configuration. In this example, power to eject an ejectable fluid from each of the nozzles (113) may be passed through each of the s-shaped dies (135).

In one example, an encapsulant (240) may be extended to cover the electrical interconnect (220) between two neighboring s-shaped dies (135) in the daisy chain configuration. In one example, an encapsulant (240) may cover those portions of the electrical interconnect (220) that are being routed to a redistribution layer of the PCB (305). In this example, less encapsulant (240) may be used to protect the electrical interconnects (220) and other electrical components exposed on the print bar (105).

The specification and figures describe an s-shaped die used in, for example, a thermal resistor type printhead or a piezo-actuated type printhead. As described herein, the s-shaped die may implement a medium-wide in-line stitching. This may be done where nozzles within a first column of nozzles overlap a second column of nozzles in the s-shaped die. Additionally, where any neighboring s-shaped dies overlap each other, stitching may also be used in order to assure that an image on the surface of a print medium includes no visual defects. Additionally, the s-shaped die allows for an electrical interconnect to be positioned on a single side of the s-shaped die. In one example, the electrical interconnection may be positioned intermediumte to the two ends of the s-shaped die. This allows for a single location for the electrical interconnect to connect the individual firing chambers of the s-shaped die to a single connection pad via a printed circuit board. Unlike where each die would have an electric interconnect on both sides of the die, the s-shaped die reduces the amount of wirebonds used in the construction of the printhead. Additionally, the side electrical interconnect uses less fire power to fire the firing chambers due to the reduced length of wiring from any given connection pad to each of the firing chambers. Further, with less wiring used, the complexity of manufacturing the medium-wide array is reduced. This may result in the reduction in cost in manufacturing the components of the medium-wide array by roughly half. Further, the use of a side electrical interconnect may minimize any interruptions to any in-line nozzle arrangements.

Additionally, the s-shaped die may use a single ejection fluid feed slot to provide to the s-shaped die a single color or type of ejection fluid. This reduces both the cost and complexity in creating multiple ejection fluid feed slots for multiple dies on a printhead die. In this case, a number of medium-wide arrays comprising a number of s-shaped dies, may be added to, for example, a printing device in order to increase the number of color and/or type of ejection fluid used. Although relatively more medium-wide arrays may be used when implementing the present medium-wide arrays described herein, a significant reduction in manufacturing costs is realized especially in the cost of silicon used to make the s-shaped die.

With a dingle s-shaped die being made instead of a number of dies being incorporated into a single die, the die width is significantly reduced. In one example, the width of the s-shaped die may be restricted by the width of the nozzles used to eject the ejection fluid and possibly the width created by the overlapping nozzles as described above.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printhead comprising:

a number of s-shaped dies embedded in a moldable substrate.

2. The printhead of claim 1, further comprising at least one electrical interconnect coupled at one location to each of the s-shaped dies.

3. The printhead of claim 2, wherein the number of s-shaped dies forms a medium-wide array.

4. The printhead of claim 1, wherein the s-shaped dies each comprise a number columns of nozzles.

5. The printhead of claim 4, wherein the number of columns of nozzles overlap and the overlapping nozzles cooperatively operate to eject ink to form an image on a substrate.

6. The printhead of claim 1, wherein the electrical interconnects are coupled to a common circuit assembly.

7. The printhead of claim 1, further comprising a number of ejection fluid feed slots wherein the ejection fluid feed slots provide a single type of ejection fluid to the number of s-shaped dies.

8. A medium-wide array, comprising:

a number of printheads, each printhead comprising:

a number of s-shaped dies; and an ejection fluid feed slot to provide a single type of ejection fluid to the s-shaped dies.

9. The medium-wide array of claim 8, further comprising a number of wirebond connections defined along a side of the s-shaped dies.

10. The medium-wide array of claim 8, wherein the number of printheads equals the number of colors provided by a printing device implementing the number of printheads.

11. The medium-wide array of claim 8, wherein the number of printheads each print two distinct types of ejection fluid via two sets of s-shaped dies each fed with a single ejection fluid feed slot.

12. An s-shaped die of a printhead, comprising:

a number of columns of nozzles; and an electrical interconnect coupled to a number of firing chambers associated with each of the nozzles, the electrical interconnect positioned adjacent to the number of columns.

13. The s-shaped die of a printhead of claim 12, further comprising an ejection fluid feed slot to provide a single type of ejection fluid to the s-shaped.

14. The s-shaped die of a printhead of claim 12, wherein each end of the s-shaped die overlaps a set of nozzles of a separate s-shaped die.

15. The s-shaped die of a printhead of claim 12, wherein the electrical interconnect couples to a side interconnect running parallel to a longitudinal axis of the s-shaped die.

* * * * *